US007959098B2

(12) United States Patent
Doppstadt et al.

(10) Patent No.: US 7,959,098 B2
(45) Date of Patent: Jun. 14, 2011

(54) HAMMER FOR A COMMINUTING DEVICE

(75) Inventors: Johann Doppstadt, Velbert (DE); Horst Berger, Calbe (DE)

(73) Assignee: Doppstadt Calbe GmbH, Calbe (DE)

( * ) Notice: Subject to any disclaimer, the term of this patent is extended or adjusted under 35 U.S.C. 154(b) by 100 days.

(21) Appl. No.: 12/225,876

(22) PCT Filed: Apr. 27, 2007

(86) PCT No.: PCT/EP2007/003764

§ 371 (c)(1),
(2), (4) Date: Oct. 1, 2008

(87) PCT Pub. No.: WO2007/124936

PCT Pub. Date: Nov. 8, 2007

(65) Prior Publication Data

US 2009/0114751 A1 May 7, 2009

(30) Foreign Application Priority Data

Apr. 28, 2006 (DE) ..... 20 2006 007 055 U

(51) Int. Cl.
*B02C 18/18* (2006.01)

(52) U.S. Cl. ..... 241/197; 241/294

(58) Field of Classification Search ..... 241/194, 241/195, 197, 293, 294, 295
See application file for complete search history.

(56) References Cited

U.S. PATENT DOCUMENTS

| | | | | |
|---|---|---|---|---|
| 2,558,107 | A * | 6/1951 | Smith | 241/194 |
| 3,545,691 | A * | 12/1970 | Arsenault | 241/197 |
| 4,871,119 | A * | 10/1989 | Murata et al. | 241/189.1 |
| 4,998,574 | A | 3/1991 | Beach et al. | |
| 5,464,164 | A * | 11/1995 | Doppstadt | 241/197 |
| 5,484,111 | A * | 1/1996 | Dorscht et al. | 241/197 |
| 6,089,480 | A * | 7/2000 | Rawlings | 241/73 |
| 6,971,598 | B2 * | 12/2005 | Schillinger et al. | 241/194 |
| 2004/0256509 | A1 | 12/2004 | Dorscht | |

FOREIGN PATENT DOCUMENTS

| | | |
|---|---|---|
| DE | 93 04 199 | 6/1993 |
| DE | 102 15 833 | 11/2003 |

OTHER PUBLICATIONS

International Search Report dated Oct. 9, 2007.

* cited by examiner

*Primary Examiner* — Faye Francis
(74) *Attorney, Agent, or Firm* — Jacobson Holman PLLC

(57) ABSTRACT

A beater for comminution devices with a rotor on or at which the beater can be fastened, including a lower body which is designed as a shaft end for connecting the beater with the rotor, and at least one cutting body. At least one cutting body is connected with the lower body in a releasable/fixed manner.

8 Claims, 1 Drawing Sheet

HAMMER FOR A COMMINUTING DEVICE

This is a national stage of PCT/EP2007/003764 filed Apr. 27, 2007 and published in German.

FIELD OF THE INVENTION

The invention refers to a beater for a comminution device with a rotor on or at which the beater can be fastened comprising a shaft end-like lower body for connecting the beater with the rotor and at least one cutting body.

BACKGROUND OF THE INVENTION

Beaters of this type are known. They are used in comminution devices which serve for comminuting material to be comminuted. In the state of the art, for example, a beater is known for that which can be fixed limited rotating on the side of the circumference on a cylinder-like basic body. The beater has here a bearing body with a bearing boring and is supported on bearings rotating by means of a bearing bolt. The bolt itself is here equipped for a screw connection.

Furthermore a beater for a rigid-hammer mill is known the bearing body of which is divided in two by an adaptation device directed transversely to the bearing body. The two bearing body parts here have openings running in the direction of the bearing boring in order to carry away penetrating parts of the material to be comminuted from the bearing points. Beater and bearing body can be designed here symmetrically as well as non-symmetrically. Non-symmetrically means in this case that they are designed with a differing width in the direction of the bearing boring or the bearing body. Furthermore a cutting body with a beater is known which also has bearing bodies penetrated by a bearing boring where a beater head is connected via a connection section. The bearing body is here arranged laterally transversely to the bearing axis of the bearing boring. The boring openings here have side surfaces. In the known cutting body with a beater at least one of the side surfaces is segment-shaped partitioned at the borings in order to improve the operational safety.

All solutions known from the state of the art referring to a beater are subject to a considerable wear during the use according to its destination. The beaters are in particular worn out strongly at their cutting faces arranged as a rule in the direction of cutting so that a frequent change of these beaters is necessary. For that purpose it is now necessary in devices with a number of beaters to exchange these beaters completely. For that purpose either the complete rotor or the entire shaft on which the beaters are located at the rotor has to be exchanged. This exchange is very complicated as, because of the wear in the use according to its destination and caused by corrosion, it is very difficult to remove these shafts. Furthermore, this leads to the fact that at least all beaters arranged on one shaft have to be exchanged altogether even if they are not yet worn out completely. This, of course, increases the expenses, and, in particular, also the standstill times of such a device.

Coming from the state of the art as described before it is the object of the invention to provide a beater which can be exchanged simpler.

SUMMARY OF THE INVENTION

The problem of the invention is solved by a beater for a comminution device with a rotor on or at which the beater can be fastened, comprising a lower body shaped like a shaft end for connecting the beater with the rotor, and at least one cutting body which is characterized in that the cutting body is fastened releasable/fixedly with the lower body. By means of this embodiment according to the invention the shaft or the rotor does not have to be exchanged when, for example, in the use according to its destination the cutting faces of the beater are worn out or damaged. Now the single cutting bodies can be dismantled from the lower body which remains connected with the shaft or the rotor, and be replaced by a new cutting body. Also, when a repair, for example the exchange of cutting plates, cutting faces or the like is necessary, this can now be carried out in a normal service rhythm without damaging the comminution works with the comminution device. The beaters can now, because only the cutting body is exchanged, be used again very fast so that the standstill times of the machine are reduced considerably. Furthermore also drawing the shaft out of the rotor or the complete dismantling of the rotor itself is avoided when repairs are necessary.

A development of the invention suggests that the cutting body is designed as a cutting plate or cutting tooth. The plate-like or tooth-like embodiment of the cutting body is preferred as it can be manufactured relatively easily. The exchange is, in addition to that, possible without any problems as the cutting bodies can be connected, for example, with suitable contact surfaces so that a shifting of the cutting bodies out of a pre-determined position then is no more possible.

A preferred development of the invention suggests that at the beater two cutting plates are arranged, in particular spaced apart from each other. Here, of course, the cutting plates are provided at the lower body in such a way that the cutting plates can be removed from the lower body if this is necessary because of their condition. The lower body of the beater can remain at the rotor or on the shaft, and does not have to be exchanged. Besides, with this way of design of the beater comminution tasks for other materials can be realized, for example wood with long fibers or softer wood can be comminuted without any problems. When beaters according to the state of the art were used for such comminution tasks there were regular problems.

According to that the cutting plates are fastened to the lower body by at least one fastening means. The fastening means can be here a regular stud which is secured with suitable securing means like split-pins or split-washers so that the screw connection does not open during use. Of course, also other fastening means are provided according to the invention. Thus the solution according to the invention also comprises fastening means like bolts, wedges, split-pins or the like. A protection of this screw connection can be done without any problems by arranging guard plates or discs.

Another aspect of the solution according to the invention is characterized in that the lower body has an eccentric-shaped extension serving for fastening the cutting plates. This eccentric-shaped extension may have, for example, a boring through which the fastening means is or are guided. Furthermore there planar surfaces are provided, in particular rectangular to the axis of a boring which is located in the lower body at which then the cutting plates are supported planar. Furthermore also the lower body has a contact surface at or on which the cutting plate(s) can be positively arranged. These may be a circular-shaped surface which is added to the lower body which corresponds with the width or plate thickness of the cutting plate, and which has a shape corresponding with the curvature of the contact surface so that a positive interlocking arrangement is given. When it is fixed at the same time by a fastening means a non-slipping or nonskid connection is provided which, however, can be released anyway in the case of service.

According to a development of the invention also the cutting plate has at least one counter surface with a shape corresponding with the contact surface at the lower body in such a way that the cutting plate can be placed with this counter surface upon the contact surface. Fixing is then carried out by a fastening means at the eccentric-shaped part of the lower body, namely the extension.

The thickness of the extension extending at the lower body and serving in particular for fastening the cutting plates, is chosen such that the extension serves as a spacer for the cutting plates. One cutting plate is therefore arranged on the left hand side, seen in the direction of cutting, and another cutting plate is arranged on the right hand side, seen in the direction of cutting. The space between these two cutting plates is limited by the thickness of the extension. The embodiment with two cutting plates is preferred because better comminution results can be achieved by it. The wear, however, in such a design is not higher as with standard beaters. The surprising result was rather that a design of this type leads to higher standing times in the comminution. Standing times here means the stability of the cutting plates.

The cutting plates are, according to a development of the invention, designed in such a way that at least one cutting element is provided at this cutting plate. The cutting element is here, of course, on the side of the cutting plate facing the direction of cutting.

It is furthermore an advantage if at least one of the cutting elements is designed, seen in the direction of cutting, wedge-like or cylinder-like. By means of that the cutting effect is even improved. The shape of the wedge or the pyramid can vary here according to the comminution tasks which have to be carried out.

Furthermore guiding surfaces are provided at the cutting plate which tamper the cutting plate in the direction of cutting in such a way that a guiding of the material to be comminuted is the result. The guiding surfaces can be here designed as grindings, and be provided in particular on both sides at the side facing the direction of cutting in such a way that a wedge is formed. Of course, it is also possible according to the invention to coat the surfaces created in this way with material which can be more heavily loaded. This can, for example, also be done by hard metal inserts which then are inserted in suitable recesses at the point of the cutting plate provided for that.

According to the invention also, of course, a through boring is provided in the lower body serving for fastening the beater on or at the rotor. The shaft itself may here be the rotor. However, it is also possible to provide several shafts of this kind on one rotor so that at the circumference of the rotor several beaters of this kind or several shafts following one after the other in the rotational direction can be arranged. It is preferred here if in the through boring a sleeve can be arranged serving as a clamping sleeve for fastening the beater on or at the rotor. This clamping sleeve here serves in particular to prevent slipping on the shaft. Of course, it is here also provided according to the invention that groove and tongue connections are provided here which also prevent the beater slipping on the rotor or the shaft.

The invention also refers to a comminution device with at least one beater according to one of the preceding described modifications of the beater according to the invention.

The invention will be described in the following by means of a single embodiment.

DETAILED DESCRIPTION OF THE PREFERRED EMBODIMENTS

Figure 1:
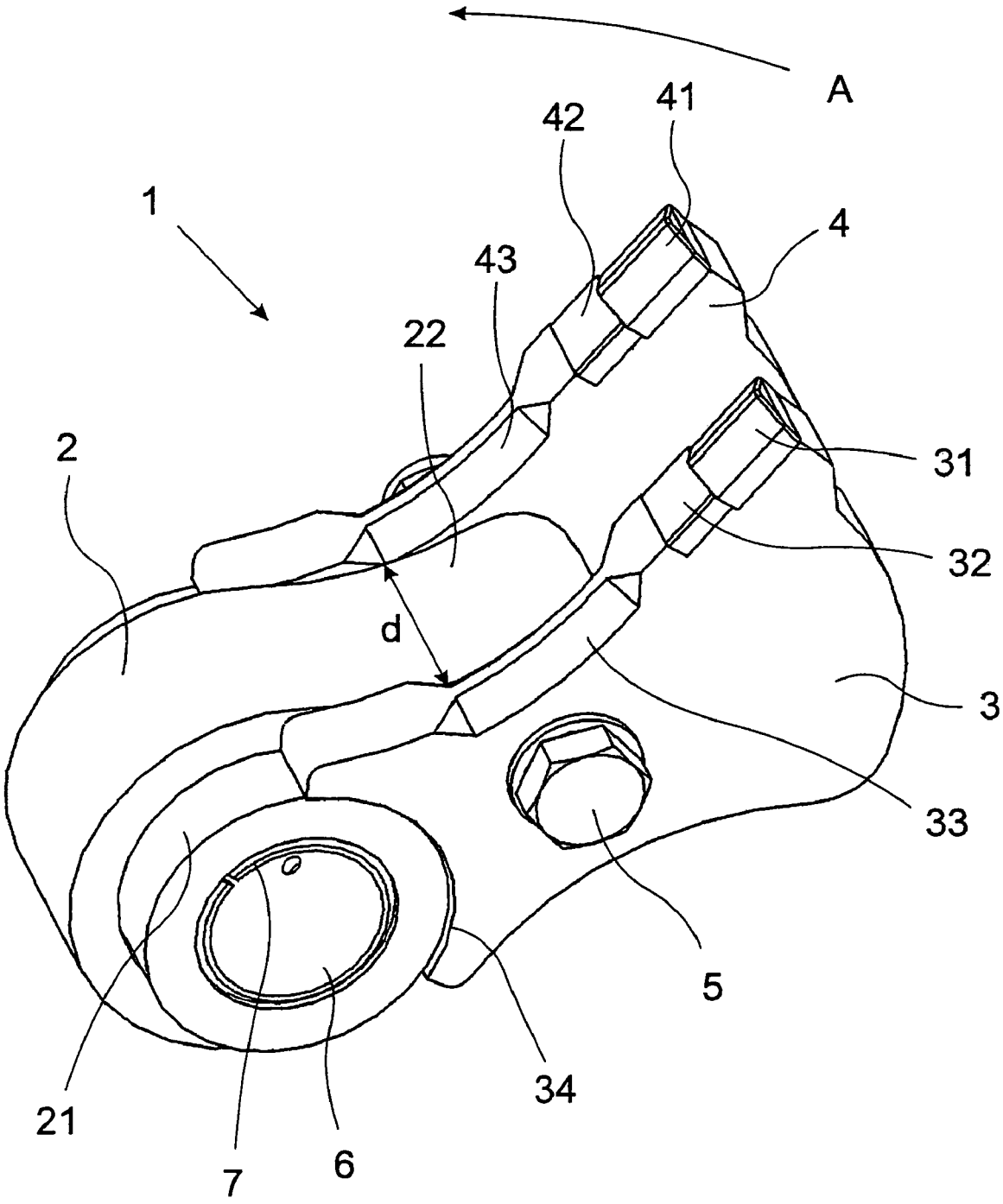
FIG. 1 a perspective illustration of an embodiment of the beater according to the invention.

In FIG. 1 a three-dimensional illustration of a beater 1 according to the invention is shown. The beater 1 according to the invention here consists of a lower body 2 which contains the through boring 6. The through boring 6 serves for slipping the beater on a not-shown shaft or rotor. Laterally then usually several beaters 1 are arranged one beside the other and screwed down so that a number of beaters can be arranged one beside the other on a shaft or a rotor. Of course, the beater according to the invention can also be used in comminution devices which have several shafts on one rotor at or on which then again a number of beaters can be fastened. For that also the beater 1 according to the invention is very well suited. In the through boring 6 a clamping sleeve 7 is shown in the example serving for a secure fastening of the beater 1 on a rotor or shaft not shown. Seen from the boring 6 at the lower body 2 an eccentric-shaped extension 22 is provided. This eccentric-shaped extension 22 serves for fastening the cutting plates 3 and 4, one cutting plate 3 being arranged on the right hand side seen in the direction of cutting A at the lower body 2 and one cutting plate 4 being arranged on the left hand side of the lower body 2 seen in the direction of cutting A. The cutting plates 3 and 4 are here fastened by a screw 5 to the lower body or the eccentric-shaped extension 22 of the lower body 2.

In order to prevent the cutting plates 3 and 4 from slipping or skidding on the lower body 2 on both sides of the lower body 2 a contact surface 21 is provided. This contact surface 21 can be reached, for example, by turning of on the lathe. It is, of course, also possible to get the entire lower body 2 including the extension 22 as a stamping or forged work. The cutting plates 3 or 4 then have counter surfaces 34 shaped correspondingly to the contact surfaces 21 by means of which the cutting plate 3 or 4 is then placed upon the contact surface 21. The thickness or width of the extension 22 is indicated by reference number d. This is chosen in such a way that a desired distance depending on the comminution task which has to be realized is kept between the two cutting plates 3 and 4. On the cutting plates 3 or 4 the cutting elements 31, 32 or 41, 42 are provided which are realized, for example, by hard metal elements. Here at least one of these cutting elements 31, 41 is shaped like a wedge or a cylinder. Furthermore, in the direction of cutting A at the cutting plate 3 or 4, preferably on both sides at one cutting plate 3 or 4 guiding surfaces 33 or 43 are provided. By the arrangement on both sides of these guiding surfaces thus also at the cutting plate 3 or 4 a wedge-like surface forms which serves on the one hand for guiding the cutting plate through the material, and, on the other hand, however, also at the same time has a certain comminution or pre-comminution effect. These guiding surfaces 33 or 43 can, of course, according to the invention also be reinforced by other materials or by welding on or inserting hard metal slabs.

The invention has been described before by means of examples. The claims filed with the application now and to be filed later on are attempted formulations without prejudice for obtaining a broader protection.

References in the sub-claims relate to the further design of the matter of the main claim through the characteristics of the respective sub-claim. These are, however, not to be understood as a waiver of independent protection of the matter for the characteristics of the referred sub-claims.

Characteristics only disclosed in the description so far may now, in the course of proceedings, be claimed as being of inventive relevance, for example to distinguish from the state of the art.

The invention claimed is:

1. Beater for a comminution device with a rotor on or at which the beater is fastened, said beater comprising a lower body having a shaft end for connecting with the rotor, said lower body having an eccentric shaped extension, and two cutting plates releasably connected by at least one fastening means to the lower body, the cutting plates being each located on one side of the eccentric shaped extension with each cutting plate having at least one cutting element and the eccentric shaped extension being a spacer between the two cutting plates, the at least one cutting element of each of the two cutting plates extending in a same cutting direction.

2. Beater according to claim 1, wherein the lower body has at least one contact surface at or on which the two cutting plates are positively arranged.

3. Beater according to claim 1, wherein the two cutting plates each have a counter surface shaped complementary to a contact surface of the lower body.

4. Beater according to claim 1, wherein the at least one cutting element is wedge-shaped or cylinder-shaped in a direction of cutting.

5. Beater according to claim 1, wherein a guiding surface of each of the two cutting plates is tapered in a direction of cutting in such a way that a result is a guiding of material to be comminuted.

6. Beater according to claim 1, wherein the lower body includes a through boring for fastening the lower body on or at the rotor.

7. Beater according to claim 6, wherein in the through boring a sleeve is arranged serving as a clamping sleeve for fastening the lower body on or at the rotor.

8. Comminution device with at least one beater according to claim 1.

* * * * *